United States Patent [19]

Schapira et al.

[11] Patent Number: 4,670,066

[45] Date of Patent: Jun. 2, 1987

[54] PROCESS FOR THE TREATMENT BY CHEMICAL CONVERSION OF SUBSTRATES OF ZINC OR OF ONE OF ITS ALLOYS, CONCENTRATE AND BATH USED FOR PERFORMING THIS PROCESS

[75] Inventors: Joseph Schapira, Paris; Victor Ken, Colombes; Francois-Joseph Duboys, Pacy sur Eure; Patrick Regnard, Asnieres, all of France

[73] Assignee: Compagnie Francaise de Produits Industriels, Gennevilliers, France

[21] Appl. No.: 765,924

[22] Filed: Aug. 15, 1985

[30] Foreign Application Priority Data

Aug. 16, 1984 [FR] France ..... 84 12878

[51] Int. Cl.[4] ..... C23C 22/12

[52] U.S. Cl. ..... 148/6.15 Z

[58] Field of Search ..... 148/6.15 T

[56] References Cited

U.S. PATENT DOCUMENTS

| | | | |
|---|---|---|---|
| 2,316,810 | 4/1943 | Romig | 148/6.15 Z |
| 2,316,811 | 4/1945 | Romig | 148/6.15 Z |
| 2,394,065 | 2/1946 | Jernstedt | 148/6.15 Z |
| 3,090,709 | 5/1963 | Henricks | 148/6.15 T |

FOREIGN PATENT DOCUMENTS

| | | | |
|---|---|---|---|
| 457493 | 1/1944 | Canada | 148/6.15 Z |
| 487851 | 9/1936 | United Kingdom | 148/6.15 Z |

*Primary Examiner*—Sam Silverberg

*Attorney, Agent, or Firm*—Fleit, Jacobson, Cohn & Price

[57] ABSTRACT

Process for the treatment by chemical conversion, within very short spaces of time of substrates of zinc or of one of its alloys especially of continuously zinc coated steel coils, wherein the bath employed in the phosphatization step proper comprises, besides the conventional constituents, a proportion of 0.3 to 2 g/l of $Fe^{2+}$ions, this bath comprising also from 0.2 to 1.5 g/l, preferably from 0.2 to 1.2 gl/ of $Zn^{2+}$ ions and from 0.3 to 2 g/l, preferably from 0.3 to 1.2 g/l of $Ni^{2+}$ ions, the weight ratios Zn/Ni and Zn Fe being comprised between 0.1 and 5, these ratios being preferably comprised respectively between 0.4 and 2 and between 0.25 and 4.

8 Claims, 6 Drawing Figures

Figure 1:
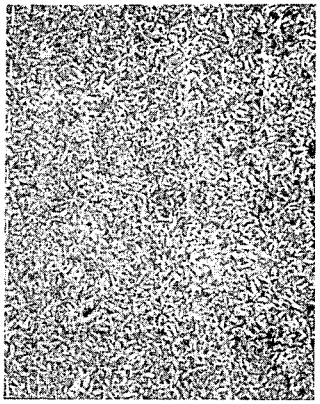

PROCESS FOR THE TREATMENT BY CHEMICAL CONVERSION OF SUBSTRATES OF ZINC OR OF ONE OF ITS ALLOYS, CONCENTRATE AND BATH USED FOR PERFORMING THIS PROCESS

The invention relates to a process for the treatment by chemical conversion within very short spaces of time, generally shorter than 30 seconds, of substrates of zinc or of one of its alloys.

It also relates to a concentrate and a bath used for performing this process.

It relates more particularly but non-exclusively to the phosphatizing of steel coils which are coated continuously with zinc (continuous coil coating), as it offers the possibility already indicated of phosphatizing a substrate in very short spaces of time, shorter even than about 10 seconds, such short spaces of time being precisely required in the industry of continuous coil coating.

The purpose of the treatment of substrates, that is to say of articles of zinc or of one of its alloys, by chemical conversion, that is to say by phosphating the zinc, is to improve the corrosion resistance of these substrates as well as the paint adhesion.

It is known that these treatments comprise, conventionally, several successive steps, namely:

(1) an alkaline degreasing step,
(2) one or several rinses with water,
(3) a preactivation step by means of titanium salts,
(4) the phosphate-coating step proper,
(5) one or several rinses with water,
(6) a chromic passivation rinse,
(7) a drying step, each of the six first steps of the treatment being performable by stream or by dipping.

The alkaline degreasing step and the water rinse(s) can be left out when continuous zinc coated steel coils are treated, such coils which have just been coated with zinc being clean.

It is also known that, conventionally, phosphatization baths with zinc comprise:

from 0.3 to 10 g/l of $Zn^{2+}$
from 5 to 50 g/l of $PO_4^{3-}$
from 1 to 40 g/l of $NO_3^-$
from 0.1 to 4 g/l of $Ni^{2+}$
from 0.1 to 3 g/l of $F^-$.

These baths may contain agents intended to reduce the coating weight, such as lactic acid, tartaric acid or starch phosphate at concentrations whih can go up to 5 g/l.

They may also contain accelerators such as $ClO_3^-$ ions, whose content may reach 5 g/l.

When, by employing known processes and baths, one obtains coating weights greater than 1.5 g/m$^2$, the deposited covering has dense crystals, but possesses poor properties as regards the adherence of the subsequently applied paint, cracking of the paint occurring if the coated and painted articles are subjected to deformations, coating weights less than 1.5 g/m$^2$, the crystals become of little density, and the chemical conversion obtained results in heterogeneous coatings, leaving bare metal in places, whence a reduced corrosion resistance.

It is a particular object of the invention to overcome the drawbacks of the prior art and to provide a process enabling the obtention on substrates consisting of zinc or of one of its alloys particularly on continuously coated coils within very short spaces of time, especially shorter than about 10 seconds, a coating of fine and dense crystals, with coating weights, of deposited phosphates, less than or equal to 1 g/m$^2$, said coatings facilitating the adherence of paints.

Now Applicants have found that this object could be achieved by adding, in a conventional phosphation bath, $Fe^{2+}$ ions, in proportions which can vary from 0.3 to 2 g/l, this bath comprising also from 0.2 to 1.5 g/l, preferably from 0.2 to 1.2 g/l of $Zn^{2+}$ ions and from 0.3 to 2 g/l, preferably from 0.3 to 1.2 g/l of $Ni^{2+}$ ions, the weight ratios Zn/Ni and Zn/Fe being comprised between 0.1 and 5, these ratios being preferably comprised respectively between 0.4 and 2 and between 0.25 and 4.

Consequently, the process according to the invention is characterised by the fact that the bath employed in the phosphatization step proper, comprises besides the conventional constituents, a proportion of 0.3 to 2 g/l of $Fe^{2+}$ ions, this bath comprising also from 0.2 to 1.5 g/l, preferably from 0.2 to 1.2 g/l of $Zn^{2+}$ ions and from 0.3 to 2 g/l, preferably from 0.3 to 1.2 g/l of $Ni^{2+}$ ions, the weight ratios Zn/Ni and Zn/Fe being comprised between 0.1 and 5, these ratios being preferably comprised respectively between 0.4 and 2 and between 0.25 and 4.

With reference to the drawing:

FIGS. 1 to 6 show the images of surfaces treated in accordance with the examples contained in the specific description for the purposes of pictorially illustrating the effect of the present invention.

The phosphatization bath according to the invention is characterised by the fact that it comprises besides the conventional constituents, a proportion of 0.3 to 2 g/l of $Fe^{2+}$ ions, this bath comprising also from 0.2 to 1.5 g/l, preferably from 0.2 to 1.2 g/l of $Zn^{2+}$ ions and from 0.3 to 2 g/l, preferably from 0.3 to 1.2 g/l of $Ni^{2+}$ ions, the weight ratios Zn/Ni and Zn/Fe being comprised between 0.1 and 5, these ratios being preferably comprised respectively between 0.4 and 2 and between 0.25 and 4.

For concentrations of $Fe^{2+}$ of the phosphatization bath according to the invention, less than 0.3 g/l, there is no beneficial effect and, in the case where the concetration is higher than 2 g/l, the covering becomes powdery and non-adherent.

The proportions of the other conventional constituents of the phosphotation bath are as follows:

from 5 to 20 g/l of $PO_4{}_-{}^{3-}$
from 2 to 12 g/l of $NO_3^-$.

The pH of the phosphate coating bath is adjusted to a value comprised between 2 and 3 by means of an alkali, like, for example, caustic soda, i.e. NaOH.

When the weight ratio Zn/Ni is higher than 5, the coating becomes insufficient; for very short coating times shorter than 10 seconds preferably the said ratio is lower than 2; at values of the ratio lower than 0.1, there is no further improvement and it becomes from the economic standpoint of view injustified to use too high nickel proportions; in the practice, the improvement obtained when the ratio is lower than 0.4, is not sufficiently important for justifying higher nickel proportions.

When the weight ratio Zn/Fe is higher than 5, the beneficial effects of the iron disappear and the behaviour of the bath is that of a classic iron-free bath; when the coating times are very short, i.e. shorter than 10 seconds, it is preferable, to use a Zn/Fe ratio of maximum 4 in order to ensure the best invariablility; when the ratio is lower than 0.1, the coating becomes powdery and non-adherent; in order to achieve the best invariability when working with very short coating times, a ratio of at least 0.25 is to be used.

Considering the very oxidizable character of the $Fe^{2+}$ ions which, in contact with air can be converted into $Fe^{3+}$ ions, resulting in the formation of insoluble sludges of ferric phosphates, a sufficient amount of a reducing agent for the $Fe^{3+}$ ions is preferably added such as ascorbic acid, oxalic acid or any other known reducing agent for $Fe^{3+}$ ions, especially in stoichiometric proportions, which, in the case of ascorbic acid, corresponds to a concentration of 0.5 to 3 g/l.

The concentrate, according to the invention, comprises in the concentration state in two separate containers but coupled preferably in the form that is generally called a treatment "kit", as regards the first container, the conventional constituents of the bath, the zinc and the nickel, as regards the second container, the ferrous ion, for example in the form of phosphate in phosphoric acid, possibly in the presence of a reducing agent by reason of the very oxidisable character of the ferrous ion indicated above.

The zinc is introduced in the form, for example, of oxide or of carbonate, for example in solution in concentrated phosphoric acid.

Nickel (or cobalt which can replace it) may be introduced in the form of oxide or of nitrate, the nitrate coming, for example, from nitric acid or from an alkali nitrate such as $NaNO_3$.

As an example of a concentrate, the following composition may be taken:

first container:

ZnO: 2% (in weight)/weight)
$H_3PO_4$ (75%): 30% (in weight/weight)
$Ni_2CO_3$: 7% (in weight/weight)
$HNO_3$ (38° B): 38.4% (in weight/weight)
gluconic acid (at 50%): 10% (in weight/weight)
water: q.s.p. 100% second container:

metallic iron (filings): 7.6% (in weight/weight)
$H_3PO_4$ (at 75%): 47.5% (in weight/weight)
water: q.s.p. 100%

The composition contained in the first container, diluted to a concentration of 23 g/l, gives the following bath:

$Zn^{2+}$: 0.36 g/l
$PO_4^{3-}$: 5.00 g/l
$NO_3^{-}$: 5.00 g/l
$Ni^{2+}$: 0.7 g/l
glutonic acid: 1.2 g/l which corresponds to a weight ratio Zn/Ni of 0.51.

To produce, in this bath, a concentration of ferrous iron of 1 g/l, there is added thereto a quantity of the contents of the second container corresponding to 13 g/l of the bath, which brings moreover, the concentration of the final bath in $PO_4^{3-}$ to 10 g/l.

The weight ratio Zn/Fe is 0,36.

The reducing agent constituted, for example, by ascorbic acid, is added separately.

As has already been indicated above, this phosphatization bath is applicable by stream or by dipping; contact times vary from 1 to 10 seconds and temperatures from 40° to 70° C.

To obtain a crystalline coating of maximum fineness, refining agents such as lactic, tartaric, citric or gluconic acids are added in proportions varying from 0.5 to 5 g/l.

In the examples which follow and which illustrate advantageous embodiments of the invention, zinc samples, particularly small plates, are subjected to the sequence of the treatments indicated below in which all the steps, except the phosphatization step proper, are constant.

The sequence of treatments concerned comprises the following steps:

(a) an alkaline degreasing step by spraying at a pressure of 1.5 kg/cm$^2$ and at a temperature of 60° C. for 8 seconds, by means of a usual alkaline degreasing product; recourse may be had to that which is marketed by Applicant Company under the trademark "RIDOLINE 1089"; it is brought to a concentration of 8 g/l;

(b) a step of one or several rinses with warm water by spraying;

(c) a preactivation step by means of colloidal titanium salts such as those marketed by Applicant Company under the trademark "FIXODINE 5"; the operation is done at the concentration of 1 g/l, at ambient temperature, by spraying, maintained for 3 seconds;

(d) the phosphatization step proper, by stream or by dipping, with the various baths described below;

(e) a step of one or several rinses with water at ambiant temperature;

(f) a final passivation rinsing step by means of a mixture of hexavalent chromium or trivalent chromium salts the product marketed by Applicant Company under the trademark "DEOXYLATE 41" may be employed, which is used at 0.3% by volume, at 40° C.;

(g) a drying step.

The thus-treated plates are then examined with an electron scanning microscope (magnification 1500); then a measurement of the weight of the coating layer follows.

This measurement is carried out in the manner explained below.

The treated plates are dried and weighed, which gives a weight $P_1$ (in grams).

They are then scoured.

To do this, they are dipped for 5 minutes into a bath, at ambient temperature, comprising 10 g/l of ammonium bichromate in an ammonia solution at 28° Baume (33.3% of $NH_3$).

The scoured plates are rinsed, dried and weighed, which gives a weight $P_2$ (in grams).

The coating weight, in g/m$^2$, is then given by the formula:

$$(P_1-P_2)/S$$

S being the surface area of the plates in m$^2$.

With respect to the examples, there are shown, in appended FIGS. 1 to 6, the images of the treated surfaces as obtained with the scanning microscope at the magnification of 1500.

EXAMPLE 1

Galvanised steel plates consisting of galvanised steel corresponding to the automobile industry standards and which has been treated mechanically and chemically to present a smooth surface with zinc crystals of small size, are subjected to the above-indicated sequence of treatments, the phosphatization bath according to the invention having the following composition:

$Zn^{2+}$: 0.35 g/l,
$Ni^{2+}$: 0.7 g/l,
$Fe^{2+}$: 1 g/l,
$PO_4^{3-}$: 10 g/l,
$NO_3^-$: 5 g/l,
ascorbic acid: 1.5 g/l,
gluconic acid: 1.5 g/l, the weight ratios Zn/Ni and Zn/Fe being respectively 0.5 and 0.35 and the pH having been adjusted with NaOH to 2.3, the temperature being 58° C. and the duration of application being 6 seconds by immersion.

The coating weight obtained is 0.85 g/m² and the crystallographic structure of this layer, illustrated by FIG. 1, shows that the crystals are fine and dense, with a covering ratio of 90%.

EXAMPLE 2

The same plates as those used in Example 1 were subjected to a treatment sequence comprising a phosphatization step proper with employment of a phosphatization bath according to the invention having the following composition:

$Zn^{2+}$: 0.5 g/l,
$Ni^{2+}$: 1 g/l,
$Fe^{2+}$: 1.5 g/l,
$PO_4^{3-}$: 10 g/l,
$NO_3^-$: 5 g/l,
ascorbic acid: 2 g/l,
gluconic acid: 2 g/l, the weight ratios Zn/Ni and Zn/Fe being respectively 0.5 and 0.33. The pH was adjusted to 2.3 with NaOH. The temperature of the bath was 55° C., the duration of application, by dipping, 6 seconds.

Figure 2:
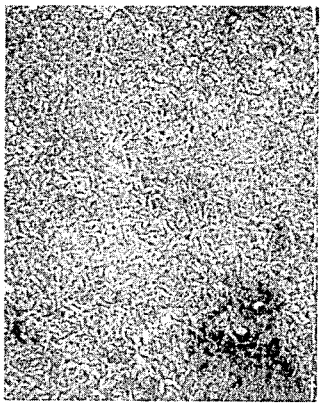
Figure 3:
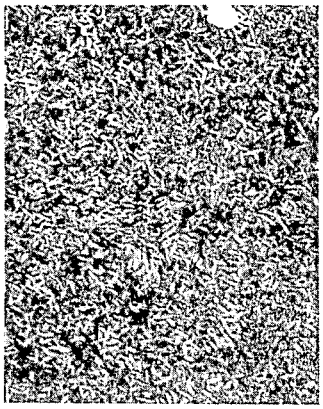
Figure 4:
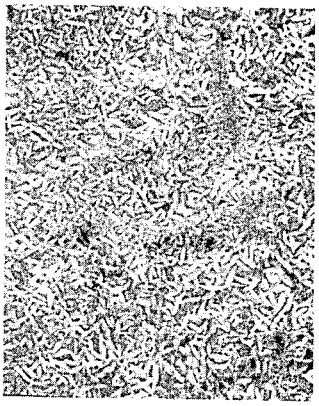
Figure 5:
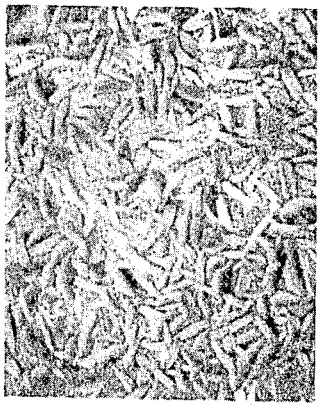
Figure 6:
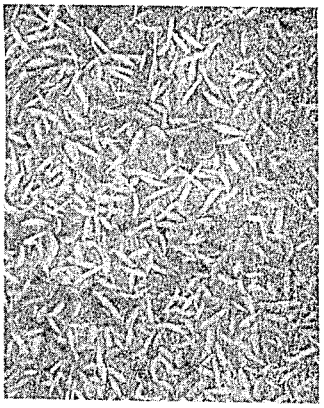

The coating weight obtained was 1 g/m². The crystallographic structure, examined as indicated above and illustrated by FIG. 2, showed that the covering was with very fine and dense crystals, with a covering ratio of 90 to 95%.

EXAMPLE 3

Plates electro-coated with zinc were subjected to a sequence comprising the phosphatization bath of Example 1, the parameters being identical, except for the temperature which was equal to 45° C.

The coating weight was, this time, 0.95 g/m². The crystallographic structure, illustrated by the photograph of FIG. 3, was of very fine and dense crystals, with a covering ratio of 85 to 90%.

EXAMPLE 4

Iron-zinc alloy plates comprising about 10% of iron such as, for example, the alloy marketed under the trademark "MONOGAL" (USINOR), were subjected to a treatment sequence comprising the phosphatization bath of Example 1: The parameters remained the same, except that the temperature was fixed at 53° C. and the treatment time, this time, was equal to 10 seconds.

The coating weight was 1.25 g/m².

The crystallographic structure (FIG. 4) showed fine and dense crystals with a covering ratio of 90%.

EXAMPLE 5

This relates to a comparative example.

Galvanised steel plates, identical with those used in Example 1, were subjected to a conventional phosphatization in the following bath, the other steps being the same as in example 1:

$Zn^{2+}$: 0.55 g/l,
$Ni^{2+}$: 0.85 g/l,
$PO_4^{3-}$: 5.3 g/l,
$NO_3^-$: 2.1 g/l,
$ClO_3^-$: 1.35 g/l.

The pH was adjusted to about 2.3 with NaOH. The temperature was 55° to 60° C. The time of application was 6 seconds, by dipping.

The coating weight was 1.1 g/m².

The crystallographic structure was characterised by coarse crystals whose covering ratio was 90%.

EXAMPLE 6

This relates to another comparative example.

The procedure was as in Example 5 but carrying out phosphatization by means of a composition used for its compatibility with a subsequent lacquering $Zn^{2+}$: 1.5 g/l,
$Ni^{2+}$: 0.6 g/l,
$PO_4^{3-}$: 8.3 g/l,
$NO_3$: 1.05 g/l,
$HBF_4$: 0.75 g/l,
lactic acid: 1.80 g/l.

The pH was adjusted to about 2.3 with NaOH. The temperature was 60° C. and the time of application was 6 seconds, by immersion.

The coating weight was 1.3 g/m².

The crystallographic structure was characterised by coarse crystals whose covering ratio was 60%.

By treating, in the case of Examples 5 and 6, metal sheets of "MONOGAL" or of electrozincked steel, a coarse, heterogeneous phosphatization was obtained, the coating weights being much higher than 1.5 g/m².

To facilitate comparison of the results recorded in Examples 1 to 6, these results are collected in the following summarising table:

SUMMARISING TABLE

| Example no. | Coating Weight (g/m²) | Crystallographic structure by examination with the electron scanning microscope with a magnification of 1500 |
|---|---|---|
| 1 | 0.85 | Very fine and dense crystals; covering ratio: 90% |
| 2 | 1 | Very fine and dense crystals; covering ratio: 90% to 95% |
| 3 | 0.95 | Very fine and dense crystals; covering ratio: 85 to 90% |
| 4 | 1.25 | Fine crystals; covering ratio: 90% |
| 5 | 1.1 | Coarse crystals; covering ratio: 90% |
| 6 | 1.3 | Coarse crystals; covering ratio: 60% |

We claim:

1. In a process for the treatment by chemical conversion of substrates of zinc or of one of its alloys including zinc coated steel coils intended to be painted, which process comprises successively at least:

a preactivation step by means of titanium salts, the phosphatization step proper, one or several rinses with water, a drying step, each of the various steps of the treatment being performable by stream of by dipping, the improvement enabling the phosphatization step proper to be achieved in less than about 10 seconds and according to which the phosphatization step proper is carried out by way of a phosphatization bath comprising, besides the conventional constituents, a proportion from 0.3 to 2 g/l of $Fe^{2+}$ ions, a proportion from 0.2 to 1.5 g/l of $Zn^{2+}$ ions and a proportion from 0.3 to 2 g/l of $Ni^{2+}$ ions, said proportions being selected in such a way that the weight ratios Zn/Ni and Zn/Fe are comprised respectively between 0.4 and 2 and between 0.25 and 4, the said bath comprising also a sufficient proportion of a reducing agent for the reduction of the $Fe^{3+}$ ions, which result from the reaction of the $Fe^{2+}$ ions with air.

2. In the process according to claim 1, the improvement according to which the phosphatization bath comprises a proportion from 0.2 to 1.2 g/l of $Zn^{2+}$ ions.

3. In the process according to claim 1, the improvement according to which the phosphatization bath comprises a proportion from 0.3 to 1.2 g/l of $Ni^{2+}$ ions.

4. In the process according to claim 1, the improvement according to which the phosphatization bath comprises a reducing agent selected from ascorbic and oxalic acid.

5. In the process according to claim 1, the improvement according to which the phosphatization bath comprises a stoichiometric proportion of ascorbic or oxalic acid.

6. Phosphatizing bath to be used in the process according to claim 7 comprising, besides the conventional constituents, a proportion from 0.3 to 2 g/l of $Fe^{2+}$ ions, a proportion from 0.2 to 1.5 g/l of $Zn^{2+}$ ions and a proportion from 0.3 to 2 g/l of $Ni^{2+}$ ions, said proportions being selected in such a way that the weight ratios Zn/Ni and Zn/Fe are comprised respectively between 0.4 and 2 and between 0.25 and 4, the said bath comprising also a sufficient proportion of a reducing agent for the reduction of the $Fe^{3+}$ ions, which result from the reaction of the $Fe^{2+}$ ions with air.

7. Phosphatizing bath according to claim 6, comprising a proportion from 0.2 to 1.2 g/l of $Zn^{2+}$ ions.

8. Phosphatizing bath according to claim 6, comprising a proportion from 0.3 to 1.2 g/l of $Ni^{2+}$ ions.

* * * * *